US009366142B2

(12) United States Patent
Butkiewicz

(10) Patent No.: US 9,366,142 B2
(45) Date of Patent: Jun. 14, 2016

(54) THERMAL PLUG FOR TURBINE BUCKET SHANK CAVITY AND RELATED METHOD

(75) Inventor: Jeffrey John Butkiewicz, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 13/283,764

(22) Filed: Oct. 28, 2011

(65) Prior Publication Data

US 2013/0108446 A1 May 2, 2013

(51) Int. Cl.

| | |
|---|---|
| ***F01D 11/00*** | (2006.01) |
| ***F01D 5/08*** | (2006.01) |
| ***F01D 5/22*** | (2006.01) |

(52) U.S. Cl.

CPC *F01D 5/08* (2013.01); *F01D 5/081* (2013.01); *F01D 5/22* (2013.01); *F01D 11/008* (2013.01); *F05D 2240/81* (2013.01); *Y10T 29/49336* (2015.01)

(58) Field of Classification Search

CPC ..... F01D 5/22; F01D 11/008; F01D 5/08; F01D 5/081; Y10T 29/49336; F05D 2240/81

USPC ..... 415/115; 416/193 A, 239, 97 R, 219 R, 416/500

See application file for complete search history.

(56) References Cited

U.S. PATENT DOCUMENTS

| | | | | |
|---|---|---|---|---|
| 3,037,741 | A * | 6/1962 | Tuft | 416/221 |
| 3,318,573 | A * | 5/1967 | Matsuki et al. | 416/91 |
| 3,644,059 | A * | 2/1972 | Bryan | 416/97 R |
| 3,664,766 | A | 5/1972 | Rahnke | |
| 3,887,298 | A * | 6/1975 | Hess et al. | 416/220 R |
| 3,897,171 | A * | 7/1975 | Stahl | 416/244 R |
| 4,111,603 | A * | 9/1978 | Stahl | 416/95 |
| 4,457,668 | A * | 7/1984 | Hallinger | 416/95 |
| 4,473,337 | A * | 9/1984 | Leonardi et al. | 416/193 A |
| 5,388,962 | A | 2/1995 | Wygle et al. | |
| 5,415,526 | A * | 5/1995 | Mercadante et al. | 416/190 |
| 5,599,170 | A * | 2/1997 | Marchi et al. | 416/190 |
| 5,630,703 | A | 5/1997 | Hendley et al. | |
| 6,371,727 | B1 * | 4/2002 | Stangeland | F01D 5/22 416/190 |
| 6,431,833 | B2 | 8/2002 | Jones | |
| 6,478,544 | B2 | 11/2002 | Brandl et al. | |
| 7,021,898 | B2 * | 4/2006 | Elliott et al. | 416/193 A |
| 7,059,835 | B2 * | 6/2006 | Tiemann | 416/96 R |

(Continued)

FOREIGN PATENT DOCUMENTS

| | | |
|---|---|---|
| EP | 1635037 A2 | 3/2006 |
| EP | 2110515 A2 | 10/2009 |

(Continued)

OTHER PUBLICATIONS

EPO Communication dated Oct. 14, 2009, Application No. 12190058.3, European Search Report (7 pgs).

*Primary Examiner* — Dwayne J White
*Assistant Examiner* — Kayla McCaffrey
(74) *Attorney, Agent, or Firm* — Nixon & Vanderhye P.C.

(57) ABSTRACT

A turbine rotor disk includes a row of buckets secured about a radially outer periphery of the rotor disk, each bucket having an airfoil, a platform, a shank and a mounting portion, the mounting portion received in a radial slot formed in the rotor disk such that adjacent buckets in adjacent radial slots are separated by a rotor disk post located between adjacent mounting portions and a shank cavity between adjacent shanks, radially outward of the rotor disk post and radially inward of adjacent platforms. The shank cavity is substantially filled with at least one discrete thermal plug.

18 Claims, 8 Drawing Sheets

(56) References Cited

U.S. PATENT DOCUMENTS

| | | | | |
|---|---|---|---|---|
| 7,097,429 | B2 * | 8/2006 | Athans et al. | 416/193 A |
| 7,374,400 | B2 * | 5/2008 | Boswell | 416/97 R |
| 7,811,058 | B2 * | 10/2010 | Tibbott et al. | 416/97 R |
| 8,128,365 | B2 * | 3/2012 | De Cardenas | 416/96 R |
| 8,393,869 | B2 * | 3/2013 | Kim | F01D 5/22 416/219 R |
| 8,622,701 | B1 * | 1/2014 | Liang | 416/95 |
| 2005/0095128 | A1 | 5/2005 | Benjamin et al. | |
| 2010/0158686 | A1 | 6/2010 | Kim et al. | |

FOREIGN PATENT DOCUMENTS

| | | |
|---|---|---|
| GB | 1457417 | 12/1976 |
| GB | 2411697 | 9/2005 |

* cited by examiner

THERMAL PLUG FOR TURBINE BUCKET SHANK CAVITY AND RELATED METHOD

BACKGROUND OF THE INVENTION

This invention relates to turbine technology generally, and more specifically, to the cooling of turbine bucket platforms.

A problem common to all high technology gas turbines is bucket platform endwall distress due to high temperatures and large temperature gradients. The distress may take the form of oxidation, spallation, cracking, bowing or liberation. Proposed solutions to address the problem employ either cooling enhancements for the inner surface of the bucket platform, located radially between the bucket airfoil and the bucket shank; creating convection cooling passages within the endwall; and/or adding local film cooling. Representative examples of prior attempts to solve the problem may be found in U.S. Published Application No, 2005/0095128; and U.S. Pat. Nos. 6,309,175; 5,630,703; 5,388,962; 4,111,603; and 3,897,171.

There remains a need for providing more effective cooling arrangements for employing existing cross-shank leakage within the bucket shank cavity to cool the bucket platform.

BRIEF DESCRIPTION OF THE INVENTION

In accordance with a first exemplary but nonlimiting aspect, the invention provides a turbine rotor disk comprising a row of buckets about a radially outer periphery of the rotor disk, each bucket having an airfoil, a platform, a shank and a mounting portion, the mounting portion received in a radial slot formed in the rotor disk such that adjacent buckets in adjacent radial slots are separated by a rotor disk post located between adjacent mounting portions and by a shank cavity between adjacent shanks, radially outward of the rotor disk post and radially inward of adjacent platforms, the shank cavity substantially filled with at least one discrete thermal plug.

In accordance with another exemplary but nonlimiting aspect, there is provided a rotor bucket assembly for a gas turbine engine comprising at least a pair of adjacent buckets secured to a rotor disk of the gas turbine engine, each bucket including a platform comprising a radially outer surface and a radially inner surface; an airfoil extending radially outwardly from the platform; a shank extending radially inwardly from the platform wherein the shank is formed with a concave surface forming an internal shank cavity; a dovetail extending radially inwardly from the shank; and wherein a plug is received in the internal shank cavity between the pair of adjacent buckets, substantially filling the shank cavity while establishing a first cooling air flow path between a radially outer portion of the plug and the radially inner surface of the platform.

In accordance with still another exemplary embodiment, there is provided a method of cooling an underside of platform portions of turbine buckets mounted on a rotor wheel wherein each bucket includes an airfoil, a platform, a shank and a mounting portion that is adapted to be received in a mating slot in the rotor wheel, and wherein adjacent shanks of adjacent buckets forms a shank cavity defined in part by the undersides of platforms of adjacent buckets, the method of comprising substantially filling the shank cavity with at least one thermal plug; and shaping the thermal plug to direct a major portion of cross-shank leakage air flow along the undersides of the platforms.

The invention will now be described in detail in connection with the drawings identified below.

DETAILED DESCRIPTION OF THE INVENTION

Figure 1:
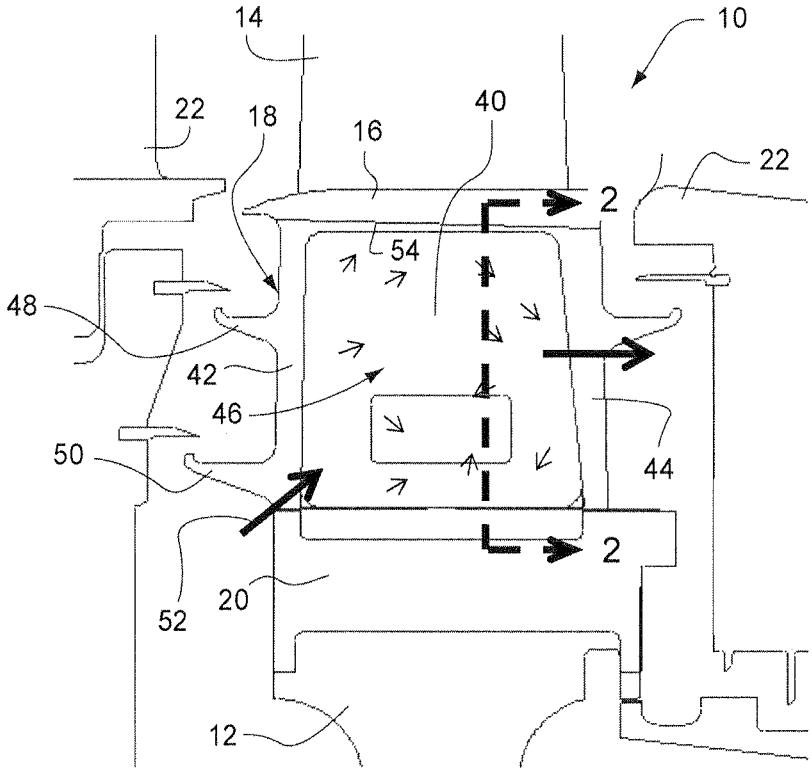
Fig. 1 (Prior Art)
FIG. 1 is a partial end view of a known turbine bucket, illustrating the shank cavity and the flow of cross shank leakage flow used to cool the bucket platform.

FIG. 1 shows a typical a rotor blade or bucket 10 adapted to be coupled to a rotor disk, represented by a post 12 on a wheel that is rotatably coupled or fixed to the turbine rotor or shaft. Blades or buckets 10 are identical, and each includes an airfoil 14, a platform 16, a shank 18, and a dovetail 20. Shank 18 extends radially inwardly from the platform 16 to the dovetail 20, and the dovetail 20 extends radially inwardly from shank 18 and is received within a mating slot formed in the rotor disc. The post 12 projects radially between adjacent slots, forming one side of each of the adjacent slots. The buckets are typically loaded axially into the slots so as to form a complete annular row of buckets about the periphery of the disc or wheel. The annular row of buckets is typically located axially between adjacent stationary rows of blades or nozzles 22 (or axially between.

Figure 7:
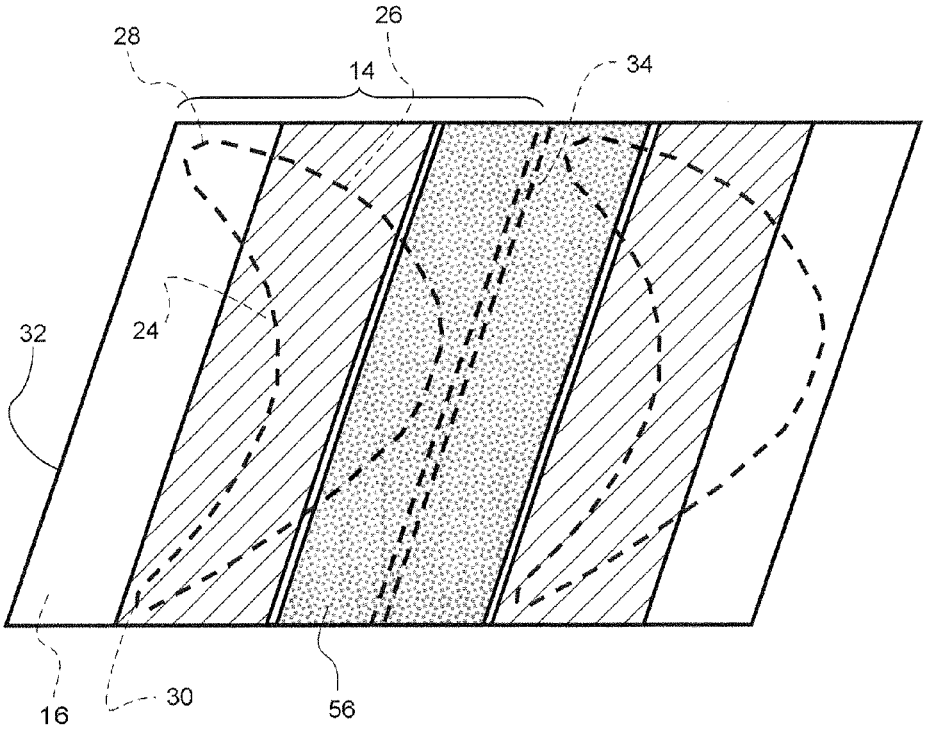
FIG. 7 is a section taken along the line 7-7 of FIG. 5.

As best appreciated from FIG. 7, each airfoil 14 includes a first or pressure side 24 and a second or suction side 26. The sides 24, 26 are joined together at a leading edge 28 and at an axially-spaced trailing edge 30. More specifically, airfoil trailing edge 30 is spaced chord-wise and downstream from the airfoil leading edge 28.

First and second sides 24 and 26, respectively, extend longitudinally or radially outward from the platform 16, to a radially outer tip (not shown).

Figure 5:
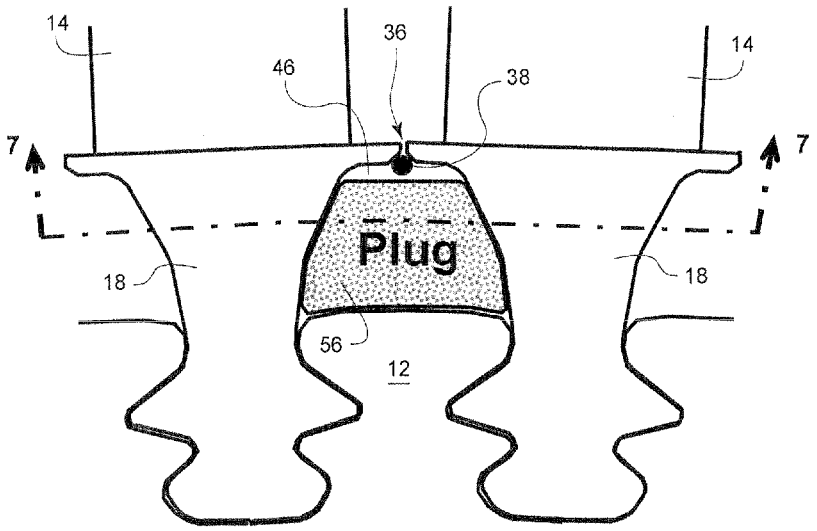
FIG. 5 is a schematic axial end view of a pair of buckets with a thermal plug in accordance with an exemplary but nonlimiting embodiment of the invention installed between adjacent shank cavities.

With continuing reference to FIG. 7, the platform 16 also has a pressure-side edge 32 and an opposite suction-side edge 34. When rotor blades 10 are coupled within the rotor assembly, a gap 36 is defined between adjacent rotor blade platforms 16, and accordingly is known as a platform gap. The gap is typically closed by a damper pin or seal 38 (see FIG. 5).

Returning to FIG. 1, shank 18 includes a substantially concave cavity sidewall 40, an upstream sidewall edge 42 and a downstream sidewall edge 44. Accordingly, shank cavity sidewall 40 is recessed with respect to upstream and downstream sidewall edges 42 and 44, respectively, such that when buckets 10 are coupled within the rotor assembly, a shank cavity 46 (see FIGS. 1 and 5) is defined between adjacent rotor blade shanks. For convenience, reference to shank cavity 46 includes the shank cavity of each bucket as well as the combined cavity formed by adjacent buckets.

Figure 2:
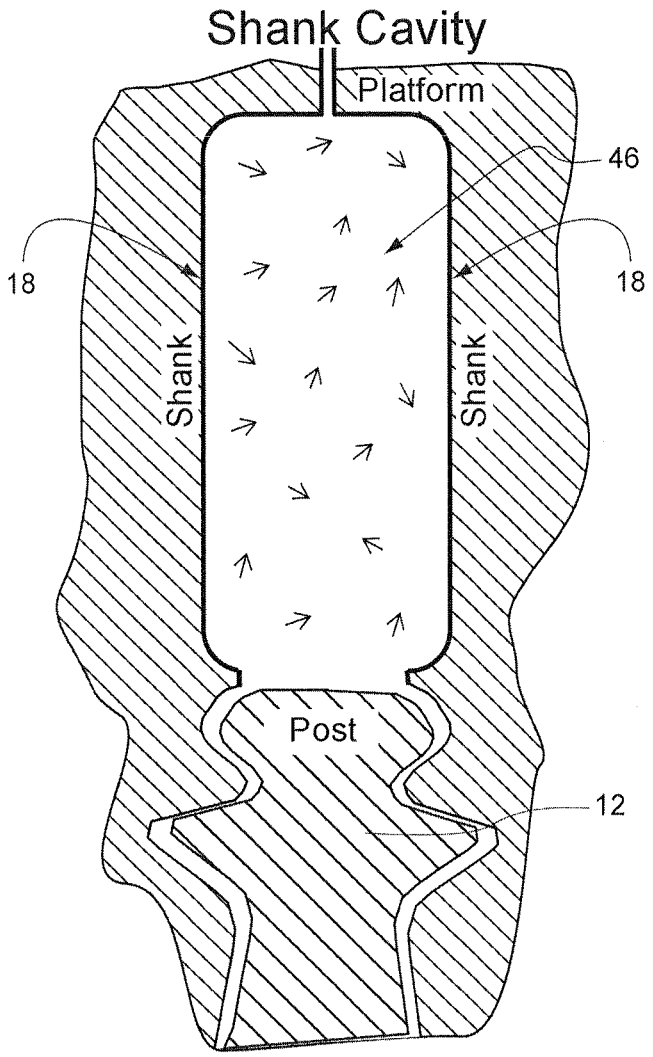
Fig. 2 (Prior Art)
FIG. 2 is a simplified side view illustrating adjacent shank cavities of respectively adjacent buckets, also showing cross shank leakage flow, viewed generally in the plane indicated by line 2-2 in FIG. 1.
Figure 3:
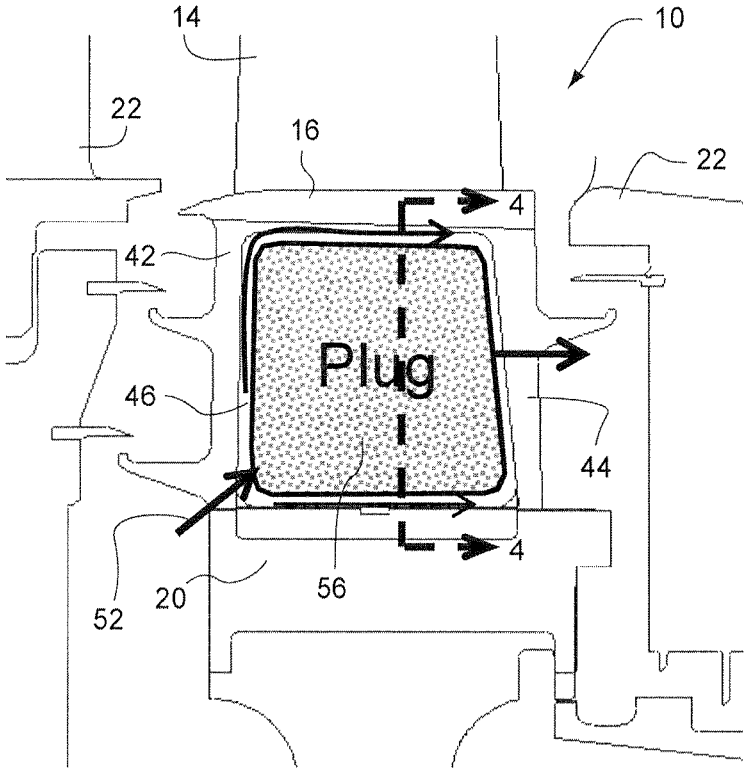
FIG. 3 is a partial end view similar to FIG. 2 but illustrating a thermal plug in accordance with an exemplary but nonlimiting embodiment of the invention, in place, within the shank cavity.

To facilitate increasing pressure within shank cavity 46 in the exemplary embodiment, shank sidewall edge 42 at the leading end of the bucket may include inner and outer angel wing seals 48, 50 that inhibit the ingress of hot combustion gas into the wheel space region radially inward of the seal 50. A recessed or notched portion, represented by flow arrow 52, is formed radially inward of the inner angel wing 50 radially adjacent the dovetail 20, permitting cross-shank leakage air is to flow into the cavity 46 to cool the cavity and, particularly, to cool the underside 54 of the platform 16. From FIGS. 1 and 2, it can be appreciated that the flow entering into the cavity 46 at location 52 is of low velocity and very chaotic, with no defined flow path between the inlet at location 52 and the exit at the sidewall edge 44, where there is a gap between it and the sidewall edge of an adjacent bucket. The gap is partially sealed by, for example, seal pins (not shown) on one or both sides of the shank cavity side wall edges 42, 44. In addition, increasing temperature of flow across the underside 54 of the platform 16 is also likely to warm the disk post 12 in the absence of any radiation shielding between the platform and disk post.

FIGS. 3-7 illustrate one exemplary but nonlimiting embodiment of the invention wherein a thermal plug 56 substantially fills the shank cavity 46 between adjacent buckets. The plug 56 is preferably a lightweight metal or metal foam that does not allow passage of air therethrough. The plug 56 has a generally rectangular configuration with four sides adapted to substantially match the shape of the cavity 46. The plug 56 may be constructed as a hollow, self-supporting shell, or a hollow shell filled with a stiffening structure such as a metal honeycomb. The plug is intended to fill most of the shank cavity 46 and direct most of the existing cross-shank leakage flow towards the platform 16, resulting in higher velocity and more effective cooling of the underside of the platform. The plug also acts as a radiation shield between the platform and the post. In addition, a minor portion of the flow will be routed radially inward of the plug 56 and therefore also serve to provide some cooling to the radially outer end of the disk post. This flow path is evident from the flow arrows in FIG. 3.

Figure 4:
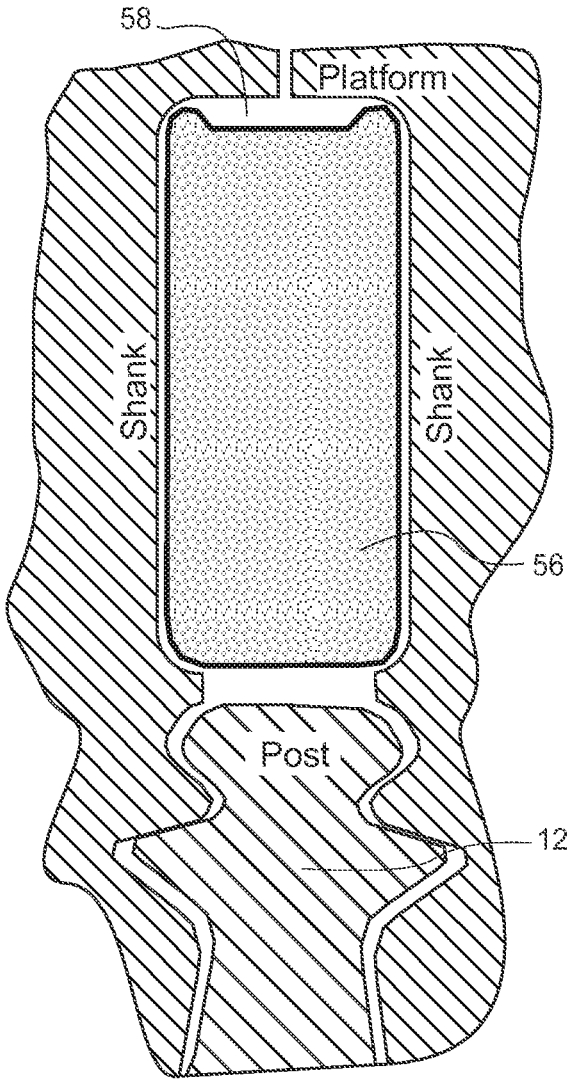
FIG. 4 is a simplified side view similar to FIG. 2 but illustrating a thermal plug in accordance with an exemplary but nonlimiting embodiment of the invention in place, substantially filling the adjacent shank cavities.

The radially-outer surface of the plug may be formed with a channel or recess 58 as best seen in FIG. 4 to provide a discrete, well-defined flow path between the plug and the underside of the platform.

Figure 6:
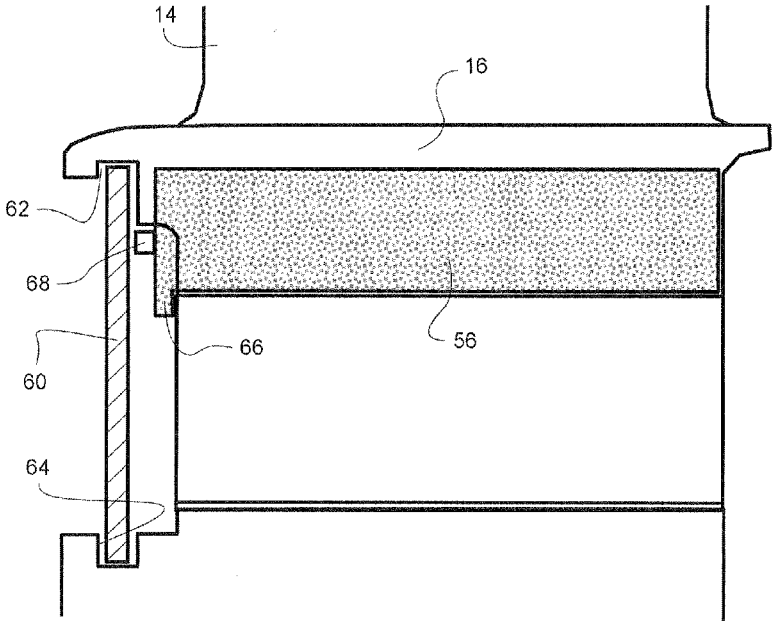
FIG. 6 is a schematic side view, sectioned radially through the thermal plug of FIG. 5, and illustrating a cover plate for axially retaining the thermal plug.

Turning to FIG. 6, a separate cover plate 60 may be secured on one side of the shank cavity, seated in grooves or notches 62, 64 formed in the platform and disk post, respectively, to retain the plug, after installation, from moving axially back out of the cavity. In this regard, a radially inward tab 66 on one end of the plug 56 keeps the plug from moving axially in the opposite or installation direction (to the right as shown in FIG. 6). A shim or spacer 68 may be employed to ensure that the plug 56 does not move axially toward the cover plate in the gap between the plug and the cover plate. With this arrangement, the plug may be installed from the forward side into the shank cavity 46 between the adjacent buckets after the buckets have been loaded onto the disk. The cover plate 60 would then be applied to hold the plug 56 in place as described above. In other applications, the plug may be inserted form the aft side of the bucket, with the cover plate installed on the aft side as well, after insertion of the plug. In this arrangement, the plug directs dedicated cooling air rather than cross-shank leakage, to the underside of the platform. The cross-shank leakage and dedicated cooling flow may both be regarded generally as "cooling flow".

Figure 8:
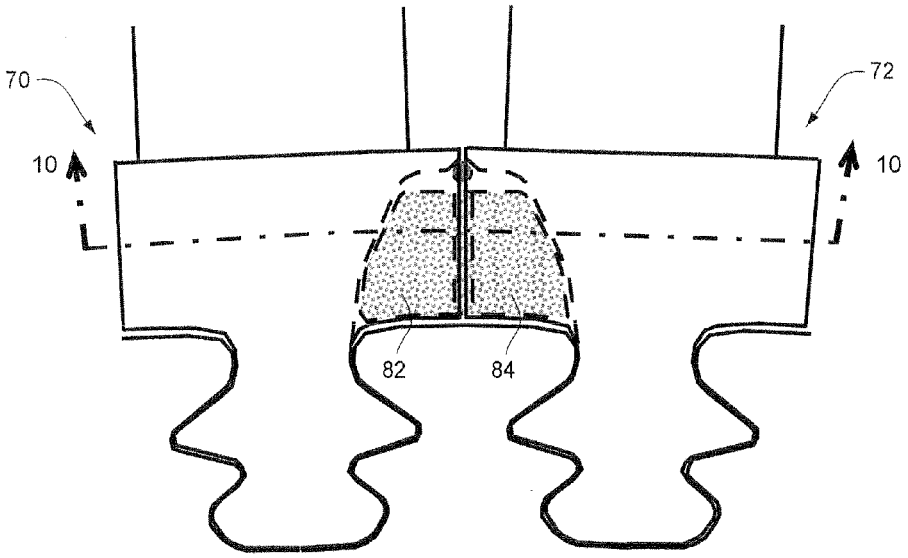
FIG. 8 is a schematic axial end view of a pair of buckets with a split thermal plug in accordance with another exemplary but nonlimiting embodiment of the invention, installed between the adjacent shank cavities.
Figure 9:
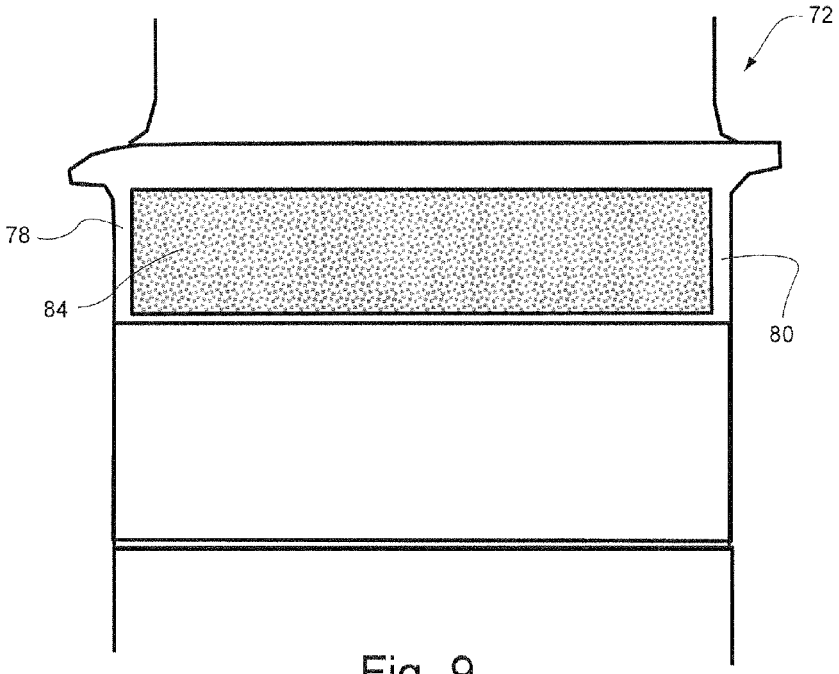
FIG. 9 is a schematic side view, sectioned through the thermal plug of FIG. 8, and illustrating integral cover plates for axially retaining the split thermal plug.
Figure 10:
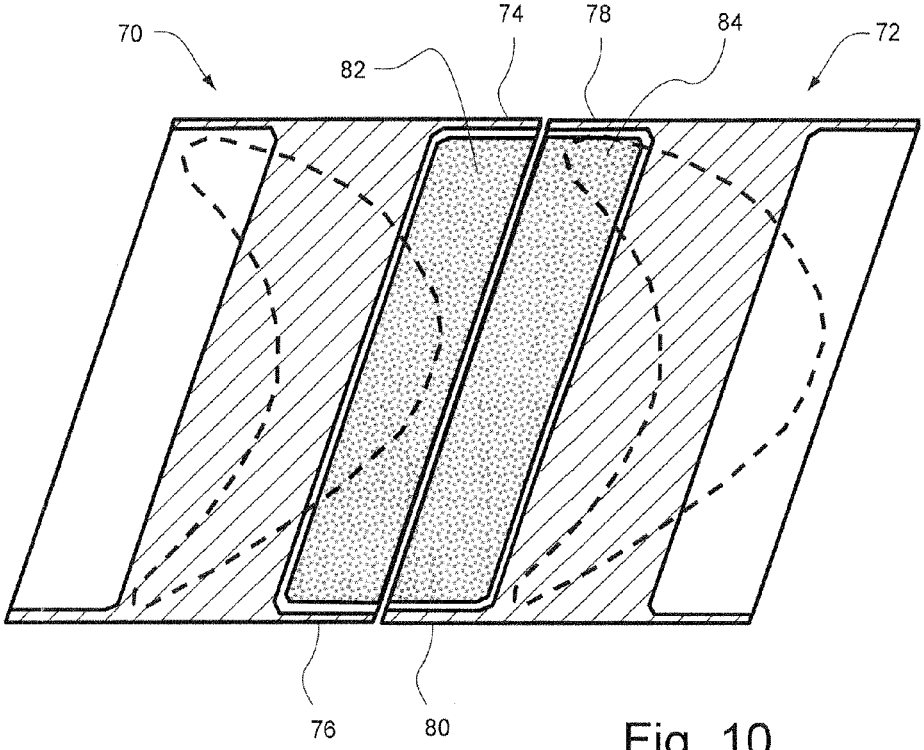
FIG. 10 is a section taken along the line 10-10 of FIG. 8.

FIGS. 8-10 illustrate another exemplary but nonlimiting embodiment where each of a pair of adjacent buckets 70, 72 are formed with integral cover plates 74, 76 and 78, 80 on both the upstream and downstream sides of the buckets as clearly evident in FIG. 10. In this case, the thermal plug is split into a pair of side-by-side plugs 82, 84 that are placed into the respective shank cavities prior to loading of the buckets into the disk. The integral cover plates 74, 76 and 78, 80 thus prevent any axial movement of the plugs within the shank cavity, but shims or spacers (not shown) may be installed as necessary between the buckets and the plugs during installation and/or removal to avoid any jostling or binding of the plugs within the shank cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine rotor disk comprising:

a row of buckets secured about a radially outer periphery of the rotor disk, each bucket having an airfoil, a platform, a shank and a mounting portion, the mounting portion received in a radial slot formed in the rotor disk such that adjacent buckets in adjacent radial slots are separated by a rotor disk post located between adjacent mounting portions and by a shank cavity formed between adjacent shanks, radially outward of said rotor disk post and radially inward of adjacent platforms, the adjacent buckets form a platform gap between said adjacent platforms; and at least one discrete thermal plug substantially filling said shank cavity, such that said thermal plug directs a cooling flow along an outer perimeter of said shank cavity;

wherein said thermal plug is shaped to form a single flow channel in the shape of a recess that extends an entire axial length along a radially outer edge of said thermal plug that is directly radially inwards of said adjacent platforms, said flow channel extends a substantial circumferential length across the platform gap and directs cooling flow along an underside of said adjacent platforms, and said thermal plug includes at least one annular protrusion located on said radially outer edge of said thermal plug to define at least one edge of said flow channel, such that said thermal plug does not abut said platform gap.

2. The turbine rotor disk of claim 1 wherein said at least one discrete thermal plug comprises a self-supporting hollow body.

3. The turbine rotor disk of claim 2 wherein said hollow body is filled with a honeycomb structure.

4. The turbine rotor disk of claim 1 wherein said at least one discrete thermal plug comprises a pair of side-by-side plugs.

5. The turbine rotor disk of claim 4 wherein said side-by-side plugs are axially retained in said cavity by cover plates integrally formed with said adjacent buckets.

6. The turbine rotor disk of claim 1 wherein said at least one discrete thermal plug is shaped to direct cooling flow along an upper surface of said rotor disk post.

7. The turbine rotor disk of claim 1 wherein said at least one discrete thermal plug is formed with an axial retention tab at one substantially axially-oriented end thereof.

8. The turbine rotor disk of claim 7 wherein said at least one discrete thermal plug is axially retained in said cavity by a cover plate.

9. A rotor bucket assembly for a gas turbine engine comprising:

at least a pair of adjacent buckets secured to a rotor disk of the gas turbine engine, each bucket including a platform comprising a radially outer surface and a radially inner surface;

an airfoil extending radially outwardly from said platform;

a shank extending radially inwardly from said platform wherein said shank is formed with a concave surface forming an internal shank cavity;

a dovetail extending radially inwardly from said shank; and wherein a plug is received in said internal shank cavity between said pair of adjacent buckets, substantially filling said shank cavity while establishing a first cooling air flow path between a radially outer portion of said plug and said radially inner surface of said platform, said platforms of said adjacent buckets form a platform gap;

wherein said first cooling air flow path is defined by a flow channel formed on said radially outer portion of said plug, said flow channel is in a shape of a recess, said flow channel extends along an entire axial length of said radially outer portion of said plug along the platform gap and extends a substantial circumferential length of said radially outer portion of said plug, said plug includes at least one annular protrusion located on said radially outer portion of said plug to define at least one edge of said flow channel such that said plug does not press against said platform gap.

10. The rotor bucket assembly of claim 9 wherein said plug comprises a hollow metal body.

11. The rotor bucket assembly of claim 10 wherein said hollow metal body is filled with a stiffening structure.

12. The rotor bucket assembly of claim 9 wherein said plug comprises a pair of side-by-side thermal plugs.

13. The rotor bucket assembly of claim 12 wherein said side-by-side thermal plugs are axially retained in said cavity and an adjacent cavity in an adjacent bucket by cover plates integrally formed with said bucket and said adjacent bucket.

14. The rotor bucket assembly of claim 9 wherein said plug is shaped to establish a second cooling air flow path along a radially outer surface of a rotor disk post extending between the dovetails of said pair of adjacent buckets.

15. The rotor bucket assembly of claim 9 wherein said plug is formed with a retention tab at one axially-oriented end thereof.

16. The rotor bucket assembly of claim 9 wherein said plug is axially retained in said cavity by a cover plate applied to said rotor disk.

17. A method of cooling an underside of platform portions of turbine buckets mounted on a rotor wheel wherein each bucket includes an airfoil, a platform, a shank and a mounting portion that is adapted to be received in a mating slot in the rotor wheel, and wherein adjacent shanks of adjacent buckets forms a shank cavity defined in part by the undersides of platforms of adjacent buckets, the method of comprising:

(a) substantially filling said shank cavity with at least one thermal plug; and (b) shaping said thermal plug to form a flow channel in the shape of a recess that extends an entire axial length and a substantial circumferential length along a radially outer edge of said plug that is directly radially inwards of said adjacent platforms, said flow channel is defined by at least one annular protrusion located on said radially outer edge of said thermal plug to define at least one edge of said flow channel such that said flow channel extends along a platform gap between said adjacent buckets, and said thermal plug does not press against said platform gap, and (c) directing cooling flow from an outer perimeter of said thermal plug to said flow channel to cool the undersides of said platforms.

18. The method of claim 17 wherein step (b) further comprising shaping said thermal plug to direct cooling flow radially inwardly of said thermal plug to cool a disk post between adjacent mating slots in said rotor wheel.

* * * * *